US007815832B2

(12) United States Patent
Clarkson et al.

(10) Patent No.: US 7,815,832 B2
(45) Date of Patent: Oct. 19, 2010

(54) MANUFACTURE OF CELLULOSE ESTER FILAMENTS: LUBRICATION IN THE SPINNING CABINET

(75) Inventors: Heather L. Clarkson, Greenville, WV (US); Cheryl F. Corallo, Charlotte, NC (US); Robina M. C. Hogan, Charlotte, NC (US); Ramiro Montez Diaz, Ocotlan Jalisco (MX); Ronald Nivins, Sherwood Park (CA)

(73) Assignee: Celanese Acetate, LLC, Dallas, TX (US)

( * ) Notice: Subject to any disclaimer, the term of this patent is extended or adjusted under 35 U.S.C. 154(b) by 1196 days.

(21) Appl. No.: 11/388,455

(22) Filed: Mar. 24, 2006

(65) Prior Publication Data

US 2007/0222102 A1 Sep. 27, 2007

(51) Int. Cl.
*D01F 2/24* (2006.01)

(52) U.S. Cl. ..... 264/187; 264/130; 264/211.14; 264/203

(58) Field of Classification Search ..... 264/130, 264/211.14, 187, 203, 178 F
See application file for complete search history.

(56) References Cited

U.S. PATENT DOCUMENTS

| | | | | |
|---|---|---|---|---|
| 4,301,101 | A * | 11/1981 | Bachmann et al. | 264/130 |
| 4,632,874 | A * | 12/1986 | Smith | 428/394 |
| 4,973,236 | A * | 11/1990 | Hasegawa et al. | 425/72.2 |
| 6,942,106 | B1 * | 9/2005 | Omar et al. | 210/457 |
| 2005/0202179 | A1 | 9/2005 | Voegtli et al. | |
| 2005/0202993 | A1 | 9/2005 | Voegtli et al. | |
| 2005/0283958 | A1 * | 12/2005 | Sanderson et al. | 28/263 |

FOREIGN PATENT DOCUMENTS

| | | |
|---|---|---|
| JP | 2004-232124 | 8/2004 |

* cited by examiner

*Primary Examiner*—Kat Wyrozebski
*Assistant Examiner*—Xue Liu
(74) *Attorney, Agent, or Firm*—Hammer & Associates, P.C.

(57) ABSTRACT

In the manufacture of cellulose ester fibers, a dope is extruded into filaments. Extrusion occurs in an elongated cabinet having an outlet for the filaments. The filaments are taken up after exiting the outlet. The filaments are lubricated at the outlet of the cabinet.

6 Claims, 1 Drawing Sheet

MANUFACTURE OF CELLULOSE ESTER FILAMENTS: LUBRICATION IN THE SPINNING CABINET

FIELD OF THE INVENTION

The present invention is directed to the manufacture of cellulose ester filaments.

BACKGROUND OF THE INVENTION

Conventionally, in the manufacture of cellulose esters filaments, the filaments are not lubricated until after they leave the spinning cabinet. One reason for this practice is to avoid the contamination of the solvent used in the extrusion of the cellulose ester filaments with the lubricant.

Conventionally, in the manufacture of cellulose ester filaments, the cellulose ester polymer is dissolved into a solvent, that solution is known as dope. The dope is pumped to a die (or jet or spinneret) having a plurality of holes therethrough. The die is typically located at the upper end of a spinning cabinet. When the dope exits the die, the solvent flashes from the dope and the filaments begin to solidify. While the filaments travel downwardly through the cabinet, the solvent is captured within the cabinet for reuse. At the bottom of the cabinet, there is an outlet through which the filaments exit the cabinet. Typically, the filaments are guided from their downward (or vertical) travel to a generally horizontal direction (including angles below the horizontal) of travel at the outlet of the cabinet. The guide may be any conventional guide device, but it does not lubricate the filaments as their direction is changed. Thereafter, the filaments exit the cabinet. After exit, the filaments are lubricated by a lubricator, for example, a kiss roll. This lubricator is typically located about 6-12 inches (15-30 cm) from the exit of the cabinet. Then, the filaments are drawn away by a feed roll.

It is believed that the filaments are damaged as they pass over the non-lubricated guide. This damage causes variability in the filament.

There is a need to make a more uniform and more robust filament product.

Japanese Application No. 2003-020952 (Publication No. 2004-232124) discloses a method for manufacturing cellulose acetate tow where finish (oil) is metered on to filaments of the tow band at the point where the various thread lines from the cabinets are converged. The point of convergence is away from the cabinet exit.

U.S. Publication Nos. 2005/0202179 and 2005/0202993 disclose a finish for improving plug making that is applied, through existing fiber finish applicators, as the filaments exit the spinning cabinet. These publications do not mention the problem solved in the instant application.

SUMMARY OF THE INVENTION

In the manufacture of cellulose ester fibers, a dope is extruded into filaments. Extrusion occurs in an elongated cabinet having an outlet for the filaments. The filaments are taken up after exiting the outlet. The filaments are lubricated at the outlet of the cabinet.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Cellulose ester filaments, as used herein, refers to, but is not limited to, cellulose acetates, cellulose propionates, cellulose butyrates, cellulose valerates, cellulose formates, and co-polymers thereof. Co-polymers include, but are not limited to, acetates-propionates or butyrates or valerates or formates and the like. Cellulose acetate refers to a cellulose acetate polymer having a typically degree of substitution between 2.1 and 2.7. For the following discussion of the invention, reference will be made to cellulose acetate, but the invention is not so limited.

Figure 1:
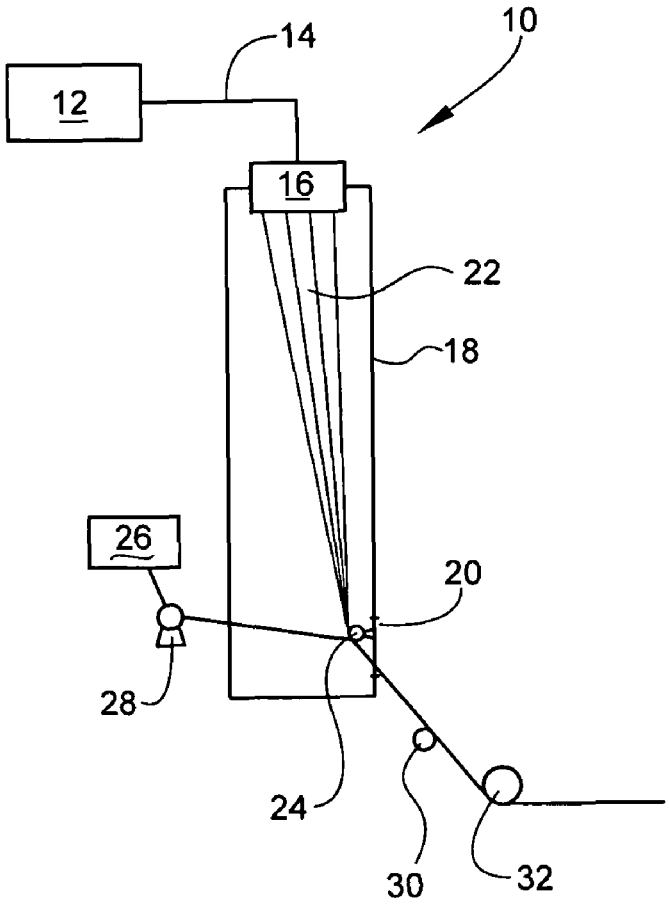
FIG. 1 is a schematic illustration of the present invention.

Referring to FIG. 1, there is shown a cellulose acetate spinning operation 10. For simplicity, only one spinning operation 10 is shown, but the skilled person will understand that there may be a plurality of spinning operations joined together (e.g., a métier). A dope supply 12 is connected to a die 16, via manifold 14. Die 16 is located at the upper end of cabinet 18. Cabinet 18 is an elongated enclosure that is used to capture the solvent (e.g., acetone when forming cellulose acetate filaments) for re-use. Cabinet 18 has an outlet 20 (typically a door or opening through the cabinet wall) through which filaments 22 exit the cabinet. A lubricant applicator 24 is located at the lowermost end of the cabinet. The placement of applicator 24 with relation to outlet 20 will be discussed in greater detail below. Applicator 24 is used to apply lubricant (discussed below) to the filaments and change the direction of travel of the filaments. After lubrication, the filaments exit the cabinet 18 via outlet 20. Filaments 22 are drawn from the cabinet 18 by feed roll 32 (or take up roll). Between outlet 20 and feed roll 32, there is a lubricator 30 which is conventional, e.g., a kiss roll. While spinning operation 10 is illustrated with filaments exiting on a side of cabinet 18, spinning operation 10 may also be a 'pass through' spinning operation where filaments exit through the bottom end of the cabinet 18.

The applicator 24 is located at the lowermost end of the cabinet and in the vicinity of outlet 20. 'In the vicinity of outlet 20' means from about six inches (15.25 cm) before to about six inches (15.25 cm) after the outlet 20, and before the lubricator 30. In one embodiment, applicator 24 is located within the cabinet before the outlet or at the outlet but in the cabinet.

Lubricant, discussed in greater detail below, is supplied to applicator 24 from a lubricant supply 26 via metering pump 28. In one embodiment, pump 28 is a peristaltic pump.

Lubricant application rates are less than 40 cc/min (when the filaments number 80-620 filaments per cabinet) to avoid excess lubricant for subsequent processing of the tow. Preferably, the rate is less than 20 cc/min, and most preferably, the rate is 5-10 cc/min.

Lubricant may be selected from the group consisting of water, oil-in-water emulsions, and oils. Typically, oils are mineral oils, as is well known in the art. The oil-in-water emulsions are well known and may include emulsifiers, antistats, and the like.

Figure 2:
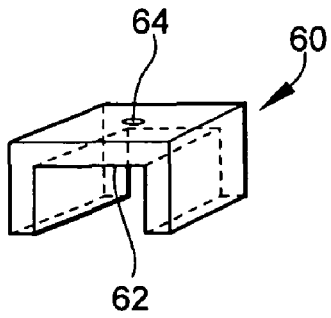
FIG. 2 is an isometric illustration of an embodiment of a lubricator.

The applicator 24 may be any type of applicator including cylindrical applicators, channel applicators, spray applicators, dip tank applicators, or brush applicators. In FIG. 2, applicator 60 is a channel-type applicator. Applicator 60 may be an inverted U with a flat surface 62. Flat surface 62 is the filament contact surface. Lubricant is introduced via inlet 64 and wets the filaments on surface 62.

EXAMPLES

The foregoing invention is further illustrated in the following non-limiting examples.

The following examples illustrate the improvement in filament properties obtained by lubrication at the outlet of the cabinet. In each of the examples, the applicator 24 (referred to as the FCPL in the Table) is located at the inside of the outlet 20. The FCPL applicator was a channel-type applicator (see FIG. 2). 'Control-1' refers to the use of a non-rotating ceramic roll with a concave surface. "Control-2' refers to the use of a ceramic channel guide with a flat surface (see FIG. 2). The 'kiss roll' refers to the conventional lubricator 30. For lubricant, 'Nothing' means no lubricant; 'H2O' means water; and 'EMUL' means an oil-in-water emulsion. Improvement in filament properties is illustrated by the coeffiecent of variation for elongation at break (% Eb CV) and tensile factor ($TE^{1/2}$). All physical properties set forth in the table below are measured in a conventional manner.

TABLE

| | FCPL | Kiss Roll | Tenacity (g/denier) | Elongation at Break (Eb %) | % Eb CV | TE½ |
|---|---|---|---|---|---|---|
| Control-1 | Nothing | EMUL | 1.03 | 22.13 | 7.50 | 4.83 |
| Control-2 | Nothing | EMUL | 1.03 | 21.40 | 4.63 | 4.79 |
| Invention | H20 | EMUL | 1.07 | 22.69 | 5.60 | 5.09 |
| Invention | EMUL | EMUL | 1.05 | 22.22 | 5.09 | 4.95 |
| Invention | EMUL | Nothing | 1.02 | 21.06 | 6.70 | 4.70 |
| Control-1 | Nothing | EMUL | 1.12 | 17.57 | 13.49 | 4.72 |
| Control-2 | Nothing | EMUL | 1.13 | 18.15 | 11.02 | 4.82 |
| Invention | H2O | EMUL | 1.27 | 21.86 | 2.15 | 5.92 |
| Invention | EMUL | EMUL | 1.26 | 22.95 | 4.97 | 6.04 |
| Invention | EMUL | Nothing | 1.22 | 22.17 | 3.88 | 5.75 |
| Control-1 | Nothing | EMUL | 1.06 | 16.64 | 21.54 | 4.37 |
| Control-2 | Nothing | EMUL | 1.10 | 17.88 | 18.35 | 4.69 |
| Invention | H2O | EMUL | 0.75 | 24.31 | 7.08 | 3.70 |

TABLE-continued

| | FCPL | Kiss Roll | Tenacity (g/denier) | Elongation at Break (Eb %) | % Eb CV | TE½ |
|---|---|---|---|---|---|---|
| Invention | EMUL | EMUL | 1.05 | 21.17 | 3.35 | 4.84 |
| Invention | EMUL | Nothing | 1.03 | 21.59 | 5.05 | 4.77 |
| Control-2 | Nothing | EMUL | 1.11 | 15.28 | 16.36 | 4.35 |
| Invention | H20 | EMUL | 1.15 | 19.17 | 5.53 | 5.02 |

The present invention may be embodied in other forms without departing from the spirit and the essential attributes thereof, and, accordingly, reference should be made to the appended claims, rather than to the foregoing specification, as indicated the scope of the invention.

We claim:

1. In the manufacture of cellulose ester filaments by extruding a dope, at an upper end and within an elongated cabinet having an outlet at a lower end, into a plurality of filaments, and taking up the filaments outside the cabinet, wherein the improvement comprises the step of:

lubricating the filaments, with an applicator located within the cabinet and adjacent the outlet, with a lubricant.

2. The process of claim 1 wherein lubricating further comprises metering the lubricant to the filaments.

3. The process of claim 2 wherein the lubricant is metered at a rate of less than 40 cc/min.

4. The process of claim 3 wherein the rate being between 5-10 cc/min.

5. The process of claim 1 wherein the lubricant being selected from the group consisting of water, oil-in-water emulsion, and oils.

6. The process of claim 5 wherein the lubricant being water.

* * * * *